US005782705A

United States Patent [19]

Solari

[11] Patent Number: 5,782,705

[45] Date of Patent: Jul. 21, 1998

[54] PUTTER CONSTRUCTION

[76] Inventor: Ray L. Solari, 101 Montreal St., Playa del Ray, Calif. 90293

[21] Appl. No.: 756,717

[22] Filed: Nov. 26, 1996

[51] Int. Cl.[6] ..... A63B 53/04; A63B 53/00; A63B 53/14

[52] U.S. Cl. ..... 473/300; 473/313; 473/314; 473/341; 473/350

[58] Field of Search ..... 473/313, 314, 473/340, 341, 342, 300, 301, 302, 303, 296, 298, 299, 350

[56] References Cited

U.S. PATENT DOCUMENTS

| | | | |
|---|---|---|---|
| 3,679,207 | 7/1972 | Florian | 473/313 |
| 4,140,318 | 2/1979 | Izett | 473/340 |
| 4,163,554 | 8/1979 | Bernhart | 473/313 |
| 4,746,120 | 5/1988 | Mockovak | 473/301 |
| 5,024,438 | 6/1991 | Candow | 473/299 |
| 5,308,067 | 5/1994 | Cook | 473/341 |
| 5,344,149 | 9/1994 | Miller | 473/341 |
| 5,382,019 | 1/1995 | Sneed | 473/314 |
| 5,398,934 | 3/1995 | Soong | 473/300 |
| 5,437,447 | 8/1995 | Rigotto | 473/341 |
| 5,454,564 | 10/1995 | Kronogard | 473/300 |
| 5,460,372 | 10/1995 | Cook | 473/303 |
| 5,544,879 | 8/1996 | Collins | 473/341 |
| 5,551,694 | 9/1996 | Grim | 473/341 |

*Primary Examiner*—Sebastiano Passaniti
*Assistant Examiner*—Stephen L. Blau
*Attorney, Agent, or Firm*—George J. Netter

[57] ABSTRACT

The putter (10) has a shaft (14) interconnecting the head (12) at an angle so the hands are at or ahead of the ball. The striking face (26) is convexly curved from toe to heel as well as canted downwardly and rearwardly (α). The grip (48) has an out-of-round cross-section to enhance a pushing stroke.

4 Claims, 3 Drawing Sheets

PUTTER CONSTRUCTION

BACKGROUND

1. Field of the Invention

The present invention relates to a golf club construction and, more particularly, to the construction of a so-called putter golf club.

2. Description of Related Art

In the game of golf, there are a variety of different clubs that are used depending upon the condition of the ground and the distance it is desired the game ball to be moved. In particular, on the portion of the course referred to as a "green", the grass is cut closer to the ground and is rolled so that it has a very smooth surface. It is intended that when a ball is on a green, instead of being struck in a manner to raise it above the green surface, it is preferably rolled along the surface. The special club for this purpose is referred to as a "putter" and has a striking face configured to move a struck ball along the ground plane of a green, and is typically the shortest club of all the clubs carried and used in the game of golf.

In satisfactory use of a putter the player swings the putter in such a direction as to desirably strike the ball at 90° to the putter striking face and along a very particular selected path to move the ball toward and into a hole on the green referred to as the cup. It is also found generally desirable to strike the ball in such a manner that it will tend to roll rather than skid along the surface since rolling action is believed to keep the ball on the direction line originally selected by the player and, therefore, enhance accuracy of play. There is, of course, always the problem of choosing a correct line along which to putt the ball in order to compensate for gradients on the green causing the ball to move transversely of the general ball movement direction. Still further in connection with making a satisfactory putt, the gradient to and away from a hole has to be evaluated since if the ball is going downhill toward the cup it does not have to be struck as hard as if it is going uphill.

Achieving all of the above desired results, a putter should preferably be constructed in a manner to enable ready evaluation by the player of the proper swinging line of the putter on any particular putt, and assist the player in making the actual decided-upon putt.

SUMMARY OF THE INVENTION

In accordance with the practice of the present invention there is provided a putter having several features that coact to promote a smooth putting swing adhering to the chosen roll line for the ball. The shaft is of conventional materials and construction with a preferable length such that the uppermost end will extend at least to belt height in the finished club.

The clubhead has a striking face with an outer surface very slightly convexly curved as measured from toe to heel, and also sloping backward preferably at least 5 degrees from top to bottom. The striking face is secured to the clubhead base by sunken-head threaded means adjacent the toe and heel ends.

The rearward slope of the head striking face from top to bottom encourages the ball to roll rather than jump up or be pushed into the green surface which has been found to promote a skipping action that is undesirable. The putter head includes a centrally located direction indicator located on the top surface of the head which is precisely aligned with the direction that it is desired to strike a putt (i.e., the putter swing direction).

The lower end of the putter shaft has an end portion bent so as to extend forward toward and intersecting the clubhead from its rear side at a point spaced away from the center of head gravity toward the heel end. The major upper part of the shaft slopes forwardly with a bent lower end portion located rearwardly of the upper handle end.

A preferred handle grip is oblong with a pair of slightly flattened opposite sides which are both parallel to the body and the direction along which the ball is desired to be moved. This grip promotes being held by both hands in a manner producing parallel to body swinging and lessening a tendency to lift the club on the backswing or make other unnecessary motions.

DESCRIPTION OF PREFERRED EMBODIMENTS

Figure 1:
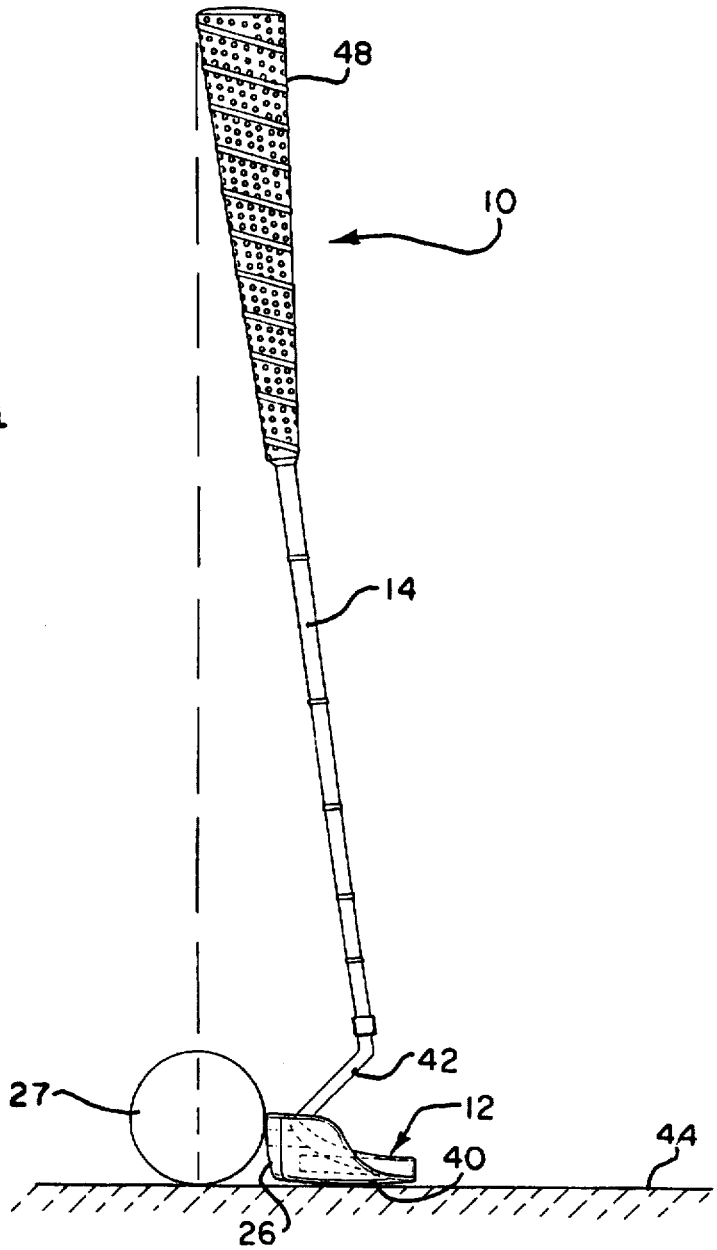
FIG. 1 is an elevational view of a preferred embodiment of the invention.

Turning now to the drawing and particularly FIG. 1, the putter of the present invention enumerated generally as 10 is seen generally to include a ball striking head 12 interconnected with a club shaft 14 which is of the "long" category (i.e., with the head resting on the ground the upper end is approximately belt to shoulder high).

Figure 2:
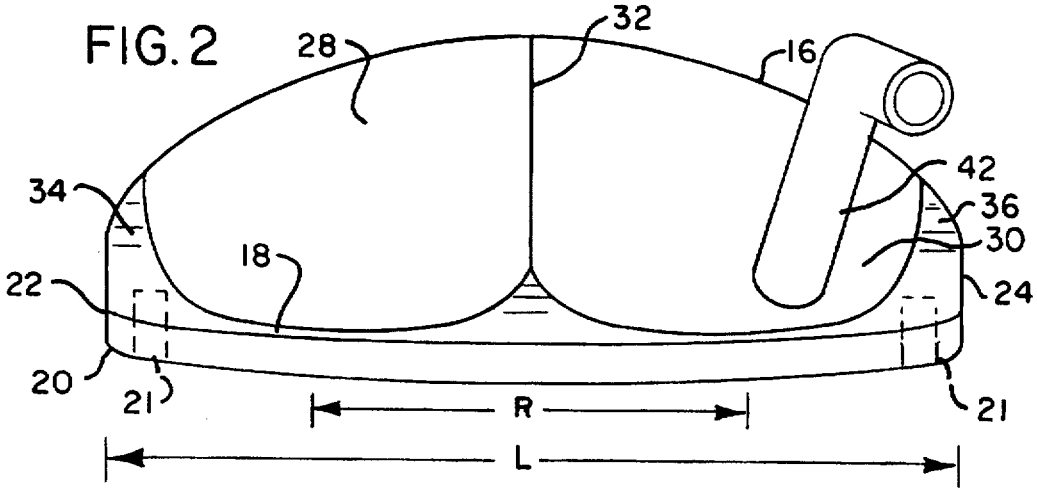
FIG. 2 is an enlarged top plan view of the putter head.

For the ensuing description of the putter head 12 reference is made additionally to FIG. 2. As shown, the head includes an elongated base portion 16 with ball striking side 18 covered by a striking plate 20 secured to the base portion by a pair of threaded members 21 located adjacent the toe end 22 and heel end 24, respectively. The base portion and striking plate have an overall length (L) at least 5 inches, but not more than 6 inches, which insures the threaded members are positioned remotely from the striking region (R). Also, the heads of the threaded members are preferably recessed within the striking plate outer surface 26 to further reduce the possibility of disturbing the delivery of putting striking force to the game ball.

Figure 3:
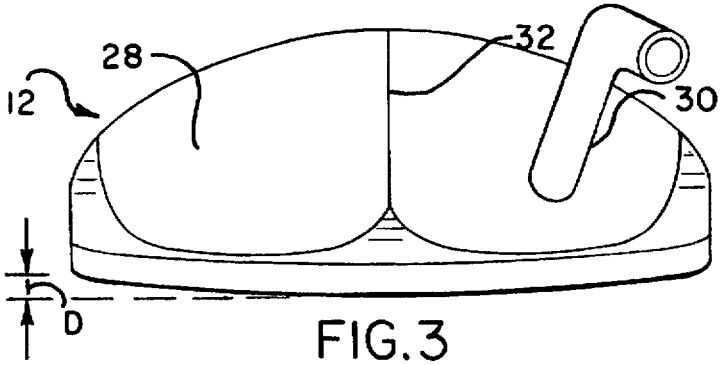
FIG. 3 is a further top plan view of the putter head.
Figure 4:
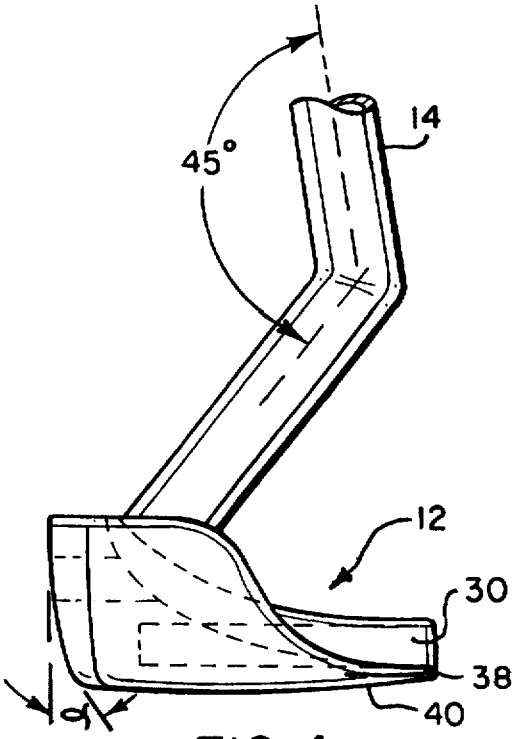
FIG. 4 is an enlarged end elevational, partially sectional and fragmentary view of the putter head.

By comparing FIGS. 3 and 4, it is seen that the striking plate outer surface 26 is gently convexly forwardly curved from toe to heel such that the center point between the toe and heel extends beyond the plane of these ends a distance D that is not more than about ⅛ of an inch. In addition to the curvature, the outer surface 26 slopes backwardly from top to bottom an angle $\alpha$ of between 90–95 degrees such that when the surface strikes a game ball 27 it tends to induce a forward rolling motion (arrow in FIG. 1) rather than a skidding or reverse rolling condition. It is generally believed that a golf ball putted so as to have a forward rolling motion will track the selected path better than a ball with sliding or other turning motion.

It is to be noted that the top and rear of the base portion 16 has material removed at regions 28 and 30 separated by an upstanding centrally located wall 32. Also, the two outer ends terminate in upstanding walls 34 and 36, respectively. By this construction, the mass of the base portion 16 is to a major extent located in a lower platelike portion 38 immediately adjacent the bottom face 40, and to a lesser extent in the centerwall 32 and end walls 34 and 36. Coupling this base portion construction with the addition of the uniform parallelipiped striking plate 20 construction generally this results in the major head weight being located at the lowest part of the base portion 16 and along the front face of the club (i.e., at the striking plate). The mass of the end walls serve to spread out the "sweet spot" (i.e., center of percussion) somewhat between the toe and heel making the club more forgiving for an off-center hit.

The putter shaft 14 is of conventional construction except adjacent the end that attaches to the clubhead there is a shaft end portion 42 formed at an extensive angle to the remainder of the shaft. Preferably, the end portion 42 joins the rest of the shaft at angle of about 45 degrees to the major shaft axis. More particularly, as shown best in FIG. 2, the outer end of the shaft portion 42 is secured to the head in the dished-out portion 30 with the plane of the two shaft parts lying generally normal to the striking plate. In this way, when the bottom surface of the head rests flat on the surface 44 of the green adjacent a ball 27, the shaft extends upwardly and forwardly so that the player's left hand (for a right handed player) is positioned at least above the ball or preferably slightly ahead of the ball toward the target. This relationship of hands, ball and clubhead reduces any tendency to lift the club off ball, but instead desirably promotes moving the clubhead along a flat straight path away from and then straight back toward the ball. In fact, the major shaft 14 axis if extended would strike the clubhead behind the point of engagement of the shaft end portion 42 with the head and at an angle less than 90 degrees which practically prevents moving the clubhead along any path other than a flat straight one away from the ball and low to the ground.

Figure 5:
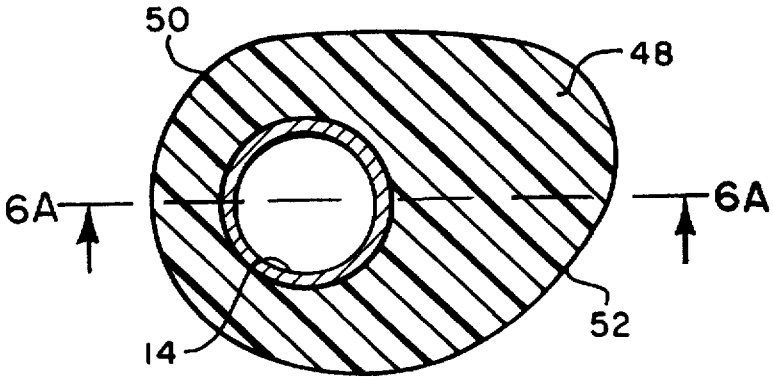
FIG. 5 shows a sectional view taken through the handgrip.
Figure 6:
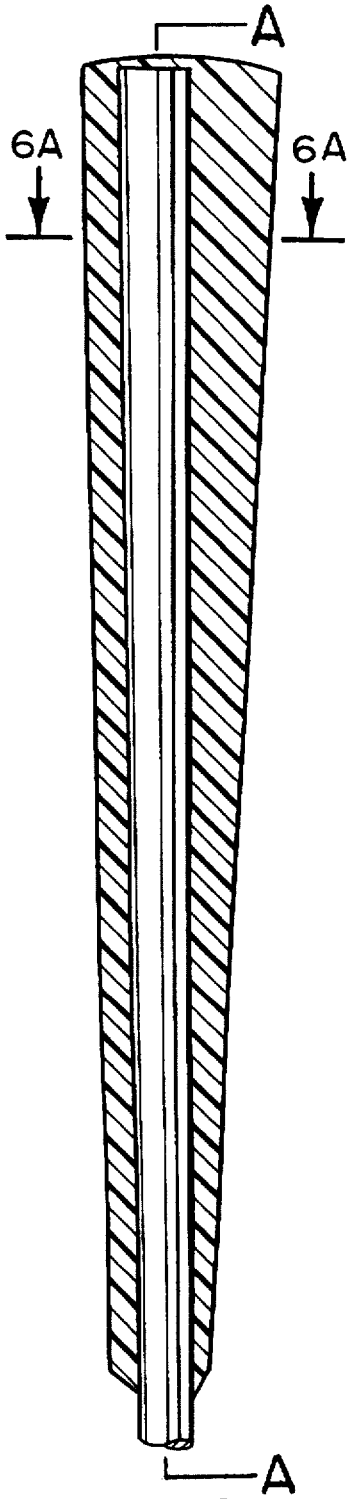
FIG. 6 is a sectional view taken along the line 6—6 of FIG. 5.

The grip 48 (FIG. 5) that is received on the upper end of the shaft 14 can be constructed of rubber, soft to the touch plastic or composition, as desired. It is seen that in section, viewing downwardly onto the grip, the grip cross-section is oblong along an axis A—A with the shaft 14 positioned off-center and more closely adjacent the side at which the left hand is placed (for righthanded players). Accordingly, in use the two hands grip the club from the two opposite sides 50 and 52, respectively, in spaced apart relation along the shaft and swing the club generally parallel to the axis A—A. With the off-center righthand gripping of the shaft on the grip 48, a steadier pushing action is achieved that will tend to hold a selected swing line. Moreover, it will be found that on assuming a given stance and direction over a ball with the described putter that the player has a difficult time making a last moment intuitive adjustment of swing path or twitch either going back or coming back through the ball.

The invention has been described specifically in connection with a "long" shaft. However, it is contemplated that when applied to a shorter shaft that the various described features will provide a putter of advantageous qualities.

Figure 7A:
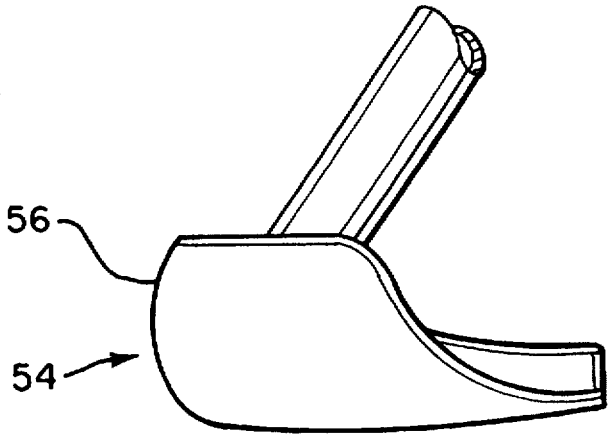
FIGS. 7A and 7B are views of two alternative embodiments with a continuously curved striking face and rearwardly sloping striking face, respectively.
Figure 7B:
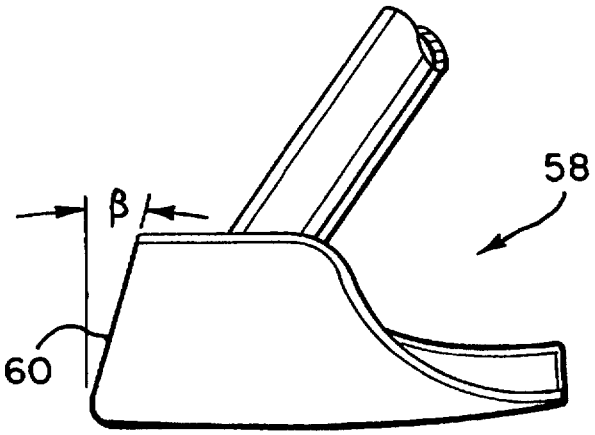

FIG. 7A shows a further embodiment of putter head 54 in the toe-to-heel curve of the first embodiment is maintained, but the striking face 56 is continuously curved top to bottom rather than canted. Yet another embodiment 58 is shown in FIG. 7B in which, again, the toe-to-heel curve is maintained, only now the striking surface 60 is curved very gently backwardly (i.e.,$\beta$ less than 5 degrees).

Although described in connection with a preferred embodiment, it is to be understood that those skilled in the appertaining arts may suggest modifications that come within the spirit of invention and within the ambit of the appended claims.

What is claimed is:

1. A putter golf club comprising: a ball striking head including, an elongated base portion with a heel end and a toe end, and a smooth bottom surface, a ball striking plate secured onto a surface of the base portion extending between the heel and toe ends, said plate having an outer ball striking face that both intersects the base portion bottom surface at an angle in the range of 90–95 degrees and is continuously convexly curved away from the base portion between the heel and the ends;

a shaft having a lower end affixed to the base portion and extending in a direction angularly upwardly and forwardly of the head and ball striking plate, said shaft including a first straight-line portion and a second integral portion angularly disposed to said first portion and having a lower outer end affixed to an upper surface of the head base portion, the angle between said first and second shaft portions being about 45 degrees, said second portion extending upwardly from the said head and rearwardly away from the striking plate; and grip means received onto the shaft upper end, said grip means being oblong in cross-section along the axis of the shaft and including an opening for the shaft located off center closer to the forward hand when the club is gripped for use.

2. A putter golf club as in claim 1, in which the plate ball striking face curvature produces a maximum deviation from a flat condition of not more than about ⅛ of an inch.

3. A putter golf club as in claim 1, in which the shaft is dimensioned so that the upper end extends to about shoulder height.

4. A putter golf club as in claim 1, in which the distance between the head toe end and heel end exceeds about 5 inches.

* * * * *